US006672905B2

(12) United States Patent
Tharp et al.

(10) Patent No.: US 6,672,905 B2
(45) Date of Patent: Jan. 6, 2004

(54) ELECTRICAL CONNECTOR COMPONENT SYSTEM

(75) Inventors: Keith F. Tharp, San Jose, CA (US); Theodore J. Colburn, Santa Cruz, CA (US)

(73) Assignee: Enhance, Inc., San Jose, CA (US)

( * ) Notice: Subject to any disclaimer, the term of this patent is extended or adjusted under 35 U.S.C. 154(b) by 14 days.

(21) Appl. No.: 10/008,088

(22) Filed: Nov. 9, 2001

(65) Prior Publication Data

US 2002/0132530 A1 Sep. 19, 2002

Related U.S. Application Data

(60) Provisional application No. 60/276,590, filed on Mar. 15, 2001, and provisional application No. 60/323,730, filed on Sep. 19, 2001.

(51) Int. Cl.[7] ..... H01R 17/00
(52) U.S. Cl. ..... 439/660
(58) Field of Search ..... 439/660, 493, 439/701, 607–610, 942, 405, 594, 502

(56) References Cited

U.S. PATENT DOCUMENTS 3,457,640 A * 7/1969 Rayburn ..... 29/418
3,713,073 A * 1/1973 Naronzy ..... 439/17
4,643,509 A * 2/1987 Hollyday et al. ..... 439/147
4,881,904 A * 11/1989 Ammon et al. ..... 439/78
4,902,242 A * 2/1990 Davis et al. ..... 439/404
5,009,614 A * 4/1991 Fogg et al. ..... 439/497
5,766,033 A * 6/1998 Davis ..... 439/405
6,039,611 A 3/2000 Yang
6,139,363 A * 10/2000 Ko et al. ..... 439/579
6,139,372 A 10/2000 Yang
6,273,749 B1 8/2001 Yang
6,354,886 B1 * 3/2002 Yu ..... 439/701

* cited by examiner

*Primary Examiner*—Ross Gushi
*Assistant Examiner*—Phuongchi Nguyen
(74) *Attorney, Agent, or Firm*—Beyer Weaver & Thomas, LLP

(57) ABSTRACT

A connector device that can reliably carry high data rates is described. The device disclosed offers multiple termination mediums and a variety of electrical packaging applications. The connector device ensures a high degree of wire position control through the use of wire retention combs and/or registration holes. The wire retention combs grip and secure portions of the discrete wires, and the registration block secures the ends of the exposed wires such that a stable connection between the wires and the electrical contact leads of the device can be maintained. In alternative embodiments, one surface of the contact leads are designed to connect with discrete wires and an opposite surface of the contact leads are designed to connect to an electronic device card. In some embodiments of the present invention, the connector device is formed of two substantially identical components that are attached to each other.

37 Claims, 8 Drawing Sheets

ELECTRICAL CONNECTOR COMPONENT SYSTEM

This application claims priority of U.S. provisional patent application No. 60/276,590, filed Mar. 15, 2001 entitled "Connector," which is hereby incorporated by reference and U.S. provisional patent application 60/323,730 Sep. 19, 2001.

This application is related to U.S. patent application Ser. No. 10/007830 entitled "HIGH DATA RATE ELECTRICAL CONNECTOR," and to U.S. patent application Ser. No. 10/007738 entitled "MULTI-FUNCTIONAL ELECTRICAL CONNECTOR," filed on the same date herewith, the content of which is hereby incorporated by reference.

FIELD OF THE INVENTION

The present invention relates generally to electrical connector devices, and more specifically to connectors for use in high data rate applications.

BACKGROUND OF THE INVENTION

Current "box level" interconnect and cabling technologies utilized by original equipment manufacturer's are driving overall system level enclosures to be smaller while increasing electrical performance of these same devices. Various requirements arise in order to facilitate the increased electrical performance of these devices. For instance, it is more critical to use highly reliable discrete wire termination methods, which are the processes for attaching the end of a line, channel or circuit to an electrical contact. It is desirable to have the option of logic (e.g., a printed circuit board) and discrete wire termination methods inside the same cabling medium. It is common for form factor requirements to drive industry standard design point data rates past intended design points. For example, Very High Density Cable Interconnect (VHDCI) connector devices designed for transmitting 40 MHz data rates actually carrying mission critical data at over 2 GHz. Of course, it is advantageous if interconnecting systems are compatible with legacy and current technologies. All of these requirements require special manufacturing processes combined with small form factor assembly and packaging methodologies. The current available industry solutions limit the ability in solving these issues cost effectively.

An important aspect of technologies for interconnecting electrical cabling involves terminating the cabling at a connector device. Current technologies from terminating cabling include insulation displacement contact (IDC), the use of printed circuit boards, solder termination, and welded or "direct attach" methods. Each of these current technologies have different characteristics, which will now be briefly explained.

IDC involves attaching wires to the electrical interconnects of a connector device by placing an insulated wire between two metal prongs, which also serve as electrical contacts. The two metal prongs cut through the insulating material and at the same time make electrical contact with the conductive wire. The electrical performance of systems utilizing IDC is limited because the skew of each wire is difficult to control. The skew is the amount of misalignment between each wire and the interconnect (or contact lead) to which it is attached. Skew causes inconsistencies in the amount of contact formed between each of the wires and a respective interconnect. The variations in the amount of contact area is a critical problem in high transmission rate applications because it disrupts the timing of the finely synchronized signals in each of the wires. Therefore, IDC is generally a lesser-preferred method for terminating cabling for critical data applications.

Printed circuit boards are used to terminate cabling by connecting PCB's to electrical interconnects and soldering discrete wires to the PCB. In this manner, the PCB's are utilized as an intermediary connecting medium and are sometimes referred to as "interposer cards." The PCB method introduces the additional discrete wire-to-interconnect termination point, which can cause further reliability and quality problems. The PCB itself also adds the cost of an additional component. PCB's actually provide some ability to improve electrical performance, for example, the embedded wire traces allow for the control of the wire layout at the PCB. However, problems arise in high frequency applications. Also, in general, the data frequency range for PCB connected systems are limited at high end, which is typically around 1 GHz.

Soldered termination involves soldering discrete wires directly to an electrical interconnect. The effectiveness of solder termination of fine pitch contacts in existing designs is limited by the ability of operators or processes to solder with a sufficient amount of precision. This naturally leads to reliability and quality problems. Additionally, material characteristics of the bond between cabling, interconnects and solder limit the performance of systems to data frequency ranges of approximately 1.2 GHz. Furthermore, current design points limit wire management options in small form factors, and electrical issues, such as skew, are virtually unsolvable at high frequencies.

Welded or "direct attach" methods involve welding wires directly to a contact surface. Skew is hard to control in welding methods due to the lack of discrete wire management features and therefore, electrical performance of the electrical system is limited. It is also very difficult to obtain consistent repeatability in welding production. Auto-indexing features of current weld tools tend to limit throughput rates. Typically, connector designs consist of multiple rows within a single housing. This usually causes problems in manufacturing since positive and negative weld plates/heads must be used. Fixturing this type of application in small form factors such as VHDCI is extremely costly.

In view of the foregoing, a low cost interconnection device capable of reliably carrying high data rates would be desirable.

BRIEF SUMMARY OF THE INVENTION

The present invention is directed to a small form factor connector device that can reliably carry high data rates and which can be implemented at a low cost. The disclosed connector device can be adopted across multiple interconnect platforms including current, legacy, or yet to be defined form factors. The device disclosed is modular in its approach, offers multiple termination mediums, and can be used in a variety of electrical packaging applications. The connector device ensures a high degree of wire position control through the use of wire retention combs and/or registration holes. The wire retention combs grip the discrete wires and the registration holes secure the ends of the exposed wires such that a stable and precise connection between the wires and the electrical contact leads of the device can be maintained. Each of these features, alone or in combination, thereby substantially reduces skew between wires and electrical interconnects of a connection device and allows for successful signal transmission at high frequencies. In alternative embodiments of the connector device, one surface of the contact leads are designed to connect with discrete wires and an opposite surface of the contact leads are designed to connect to an electronic device card. In some embodiments of the present invention, the connector device is formed of two substantially identical components that are attached to each other.

One aspect of the present invention relates to a substantially symmetrical electrical connector that includes a pair of substantially identical connector components that are attached to each other. A plurality of contact leads are positioned within each of the connector components and each of the plurality of contact leads have a first connection portion suitable for making contact with an external connector device, a second connection portion suitable for making contact with electrical wires, and a third connection portion suitable for making contact with traces on an electrical device.

These and other features and advantages of the present invention will be presented in more detail in the following specification of the invention and the accompanying figures, which illustrate by way of example the principles of the invention.

BRIEF DESCRIPTION OF DRAWINGS

The invention, together with further advantages thereof, may best be understood by reference to the following description taken in conjunction with the accompanying drawings in which.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known operations have not been described in detail so not to unnecessarily obscure the present invention.

The connector device of the present invention has features that allows for precise connections to electrical wires, the flexibility to connect to both wires and an electrical device card, allows for easier termination to such devices, and has a design amenable to low cost production. The features that allow for such characteristics will now be described with respect to the figures.

Figure 1:
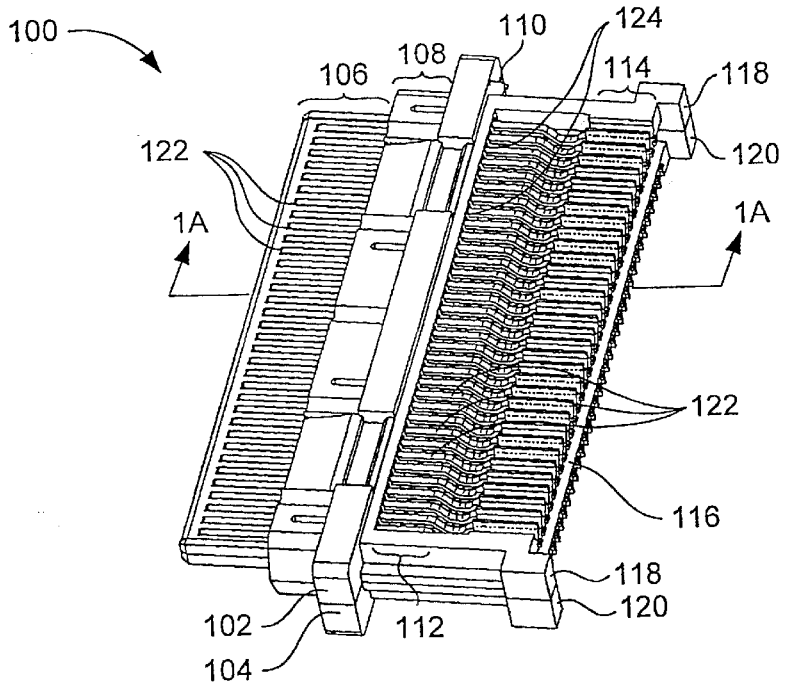
FIG. 1 illustrates a perspective view of a connector device according to one embodiment of the present invention.

FIG. 1 illustrates a perspective view of a connector device 100 according to one embodiment of the present invention. Connector device 100 is designed to connect discrete wires and/or an electrical device card, such as a PCB card, to an electrical system, such as a personal computer, server, etc. Connector device 100 is formed of two substantially similar connector components 102 and 104 that are placed together, thereby giving the connector device 100 a symmetrical shape. In some embodiments, connector components 102 and 104 can be identical in shape and/or size to each other. Each of the connector components 102 and 104 have a wipe area or termination strip 106, a shroud support ledge 108, a wire registration block 110, a discrete wire contact region 112, and a wire retention comb 114. Each of the connector components 102 and 104 are formed such that when they are placed together, a device card slot 116 is created. Device card slot 116 is designed to receive and secure an electronic device card, which can be used as a wire termination medium. Specifically, the device card itself, sometimes referred to as an interposer card, will be attached to electrical wires. To guide a device card into device card slot 116, registration surfaces 118 and 120 are formed on each end of each connector component 102 and 104, respectively. It should be noted that device card slot 116 can receive various types of connection mediums that are able to fit inside the slot 116. In alternative embodiments of the present invention, the connector components 102 and 104 do not have to be substantially similar or identical in shape and/or size. For instance, each of the components 102 and 104 can have different shapes to conform to different design requirements.

Within each of the connector components 102 and 104, electrical contact leads 122 extend from the surface of the wipe area 106, to the surface of the wire contact region 112, and finally, to the inside surface of the device card slot 116. At least a portion of the inside surface of the contact leads 122 are designed to make contact with the electrical traces on a device card that is inserted into the device card slot 116. The wire contact region 112 on the outside surface of the contact leads 122 are designed to connect with discrete wires. The exposed contact leads 122 on the surface of the wipe areas 106 are designed to make contact with an electrical system when the wipe area 106 is connected with an external connector of the electrical system. The structural region formed by the combined wipe areas 106 of the two connector components 102 and 104 is sometimes referred to as a termination strip. Connector device 100 is thereby able to connect both discrete wires and a device card to an electrical system. The connector device 100 can be used in various ways such that in some embodiments, only discrete wires are attached, in others only a device card is inserted, and sometimes, both discrete wires and a device card can be connected to the connector device 100.

The fact that the connector device of the present invention is formed from two similar components is advantageous for various reasons. First, forming the connector device 100 from two similar or identical connector components 102 and 104 allows for lower overall production costs since less tooling is required to manufacture components having different configurations. Also, assembling and attaching wires to the connector device becomes simpler since the connector components can be worked with separately. This is especially advantageous given that the connector devices of the present invention are intended to be manufactured to have small form factors. As should be appreciated by those of skill in the art, the connector components that form the connector device are preferably made of a dielectric material. In alternative embodiments of the present invention, the connector device 100 can be formed from a single piece of material, rather than be formed from two separate halves. In other embodiments of the invention, the connector device could have contact leads 122 on only one side of the connector device.

Registration block 110 and wire retention comb 114 are provided to firmly secure the connection of each of the discrete wires to the wire contact regions 112 of respective contact leads 122. The registration block 110 stretches across the width of the connector device 100 and includes registration holes 124 that are aligned with each of the contact leads 122. By inserting the end of each discrete wire into a respective registration hole 124, the end of each wire can be accurately secured, thereby aligning one end of each of the wires with a respective contact lead 122 to which the wire will be connected. Such alignment also tends to align the longitudinal axis of the wires with the longitudinal axis of the wire connection regions 112 of the contact leads 122. Each of the registration holes 124 preferably have the same depth so that the ends of the wires attached to the wire connection region 112 are aligned along the same axis. The diameter of each registration hole 124 should be sized to securely restrain the ends of each wire above a respective contact lead 122. The registration holes provide added precision in the termination of discrete wires to contact leads, which is critical in high speed data applications.

The wire retention comb 114 includes a set of teeth that are designed to receive and secure the discrete wires. The width between each teeth of the retention comb 114 is sized so that each pair of teeth can firmly secure a wire to the connector device through frictional forces. Preferably, each pair of teeth will grip onto the insulated portion of a discrete wire. The teeth are positioned such that each wire will be secured directly above the wire connection region 112 of a respective contact lead 122. The retention comb 114 thereby increases the stability and strength of the electrical connection between the discrete wires and the contact leads 122 in the wire contact region 112. The registration block 110 and the retention comb 114 work together to strengthen the connection between the discrete wires and the contact leads 122 by securing both ends of each of the wires that will make contact with the wire connection region 112 of the contact leads 122. The registration block 110 and the retention comb 114 also ensure that the longitudinal axes of both the wires and the wire connection regions 112 of the contact leads align with each other. Additionally, the wire retention comb 114 provides the discrete wires with strain relief, which is the ability of the wires to remain connected to the contact leads 122 despite forces applied to the wires during physical handling of the connector device 100. The wire retention comb 114 provides added precision in the termination of electrical wires to the contact leads, thereby making the connector device 100 capable for convey data at high rates.

In alternative embodiments of the present invention, the connector device may only incorporate either the registration block 110 or the retention comb 114, but not both. Such design considerations will depend upon the specific application for which the connector device will be used.

The shroud support ledge 108 provides a surface upon which to attach a shroud in order to cover and protect the exposed contact leads 122 on the surface of the wipe areas 106.

Figure 1A:
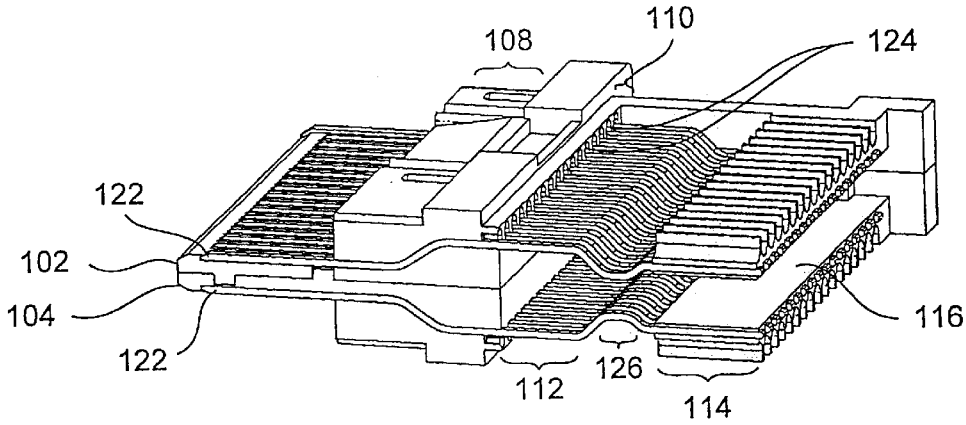
FIG. 1A illustrates a sectional view of the connector device of FIG. 1 along line 1A—1A.

FIG. 1A illustrates the connector device 100 in greater detail. FIG. 1A illustrates a sectioned view of connector device 100 along line 1A—1A, as shown in FIG. 1. A contact lead 122 can be seen within the sectioned surface of the connector device 100 to run from the wipe area 106 to the wire contact region 112 and then to the device card contact region 126. Due to the drawing limitations required for clarity purposes within FIG. 1A, the bracket designating device card contact region 126 is position on the outside of connector device 100 even though device contact regions 126 are located on the interior surface of the device card slot 116. The contact leads 122 have a bending profile that can be more clearly seen in FIG. 2.

Also, as can be seen in FIG. 1A, the top and bottom surfaces of the wire contact regions 112 in each of the connector components 102 and 104 are exposed between the registration block 110 and the wire retention comb 114. Exposing both the top and bottom surfaces of the wire contact regions 112 is useful when the connector components 102 and 104 are separated from each other. For when the connector components are separated from each other, welding mechanisms can more easily make contact with the contact leads 122 on the two separate surfaces to form the required electrical circuit. The exposure of the wire contact regions 112 makes it possible to mass weld a respective wire onto each of the plurality of contact leads simultaneously.

Figure 2:
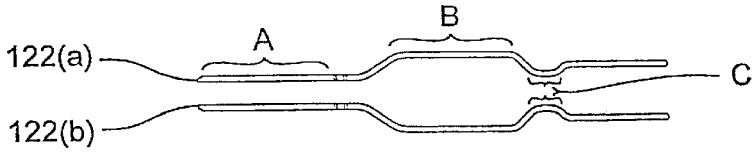
FIG. 2 illustrates a side elevation, plan view of a pair of contact leads from the connector device of FIGS. 1 and 1A.

FIG. 2 illustrates a side plan view of an isolated pair of conductive contact leads 122(*a*) and 122(*b*), shown in their relative orientations when connector components 102 and 104 are placed together. Contact lead 122(*a*) represents a contact lead from connector component 102 and contact lead 122(*b*) represents a contact lead from connector component 104. Section A is the portion of the connector leads 122 in the wipe area 106. The outside portions of the contact leads in section B make contact with discrete wires in the wire connection area 112, and the inside portions of the contact leads in section C make contact with a device card in the device contact region 126. Note that the contact surfaces in sections B and C are on opposite surfaces of the contact leads 122. The contact leads 122 bend inwards at section C to form a leaf spring configuration such that the contact leads 122(*a*) and 122(*b*), together, exert a compressive force on an inserted device card. The compressive force provides a more secure connection between the connector device 100 and an inserted device card. In some embodiments, the longitudinal axes of the contact leads 122 in sections A and C are within the same plane. In other embodiments, depending upon the design requirements, the contact leads in section C are closer to each other than the contact leads in section A.

The connector device 100 can have a varying number of contact leads 122 that span the length of each connector component 102 and 104 depending upon the specific data application. In one common embodiment, each of the connector components 102 and 104 have thirty-four (34) contact leads 122 such that connector device has a total of 68 contacts.

The connector device of the present invention is versatile with respect to the various termination methods that can be utilized. As shown above, discrete wires and device cards can be attached to the connector device 100. Discrete wires can be terminated through soldering or through welding, which creates a direct metallurgic bond. In soldering and welding type terminations, mass or discrete termination of wires is possible since the wire contact regions 112 are not obstructed to machining tools. Mass termination refers to the process of simultaneously connecting multiple wires to respective contact leads. On the other hand, discrete termination refers to connecting wires individually to respective contact leads. To accomplish the various termination methods, the only changes needed are in the plating of the contact leads 122. For instance, when soldering the discrete wire attachment, tin and lead is used, and when the wires are welded to the contact leads 122, nickel is used to plate the contact leads 122. In some applications of the connector device of the present invention, each of the pair of connector components of the connector device 100 could be terminated to discrete wires using different techniques depending upon specific design criteria.

The device card can be attached to the connector device of the present invention via soldering with tin and/or lead.

Embodiments of the connector device can be based on the Very High Density Cable Interconnect (VHDCI) standard, which is applicable to Low Voltage Differential-Small Computer System Interface (LVD-SCSI) applications for both current and legacy interconnect schemes. VHDCI connectors and retention schemes comply with physical interface and performance requirements set forth in Standard Proposal No. 3652-A, issued by the Electronic Industries Association.

Figure 3:
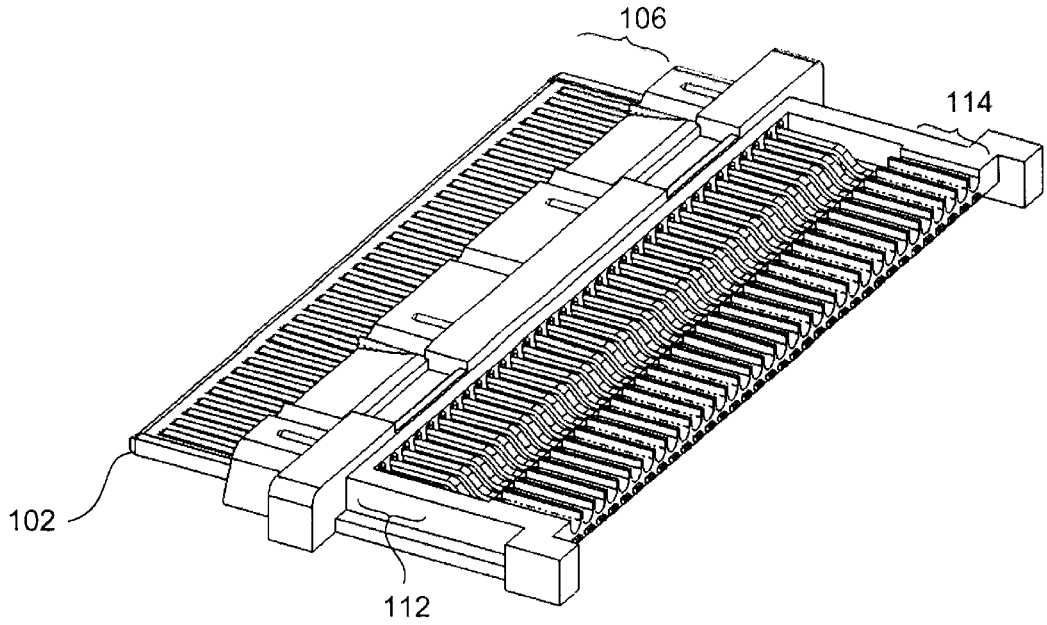
FIG. 3 illustrates a perspective view of the outside surface of an individual connector component used to form the connector device as shown in FIGS. 1 and 1A.
Figure 4:
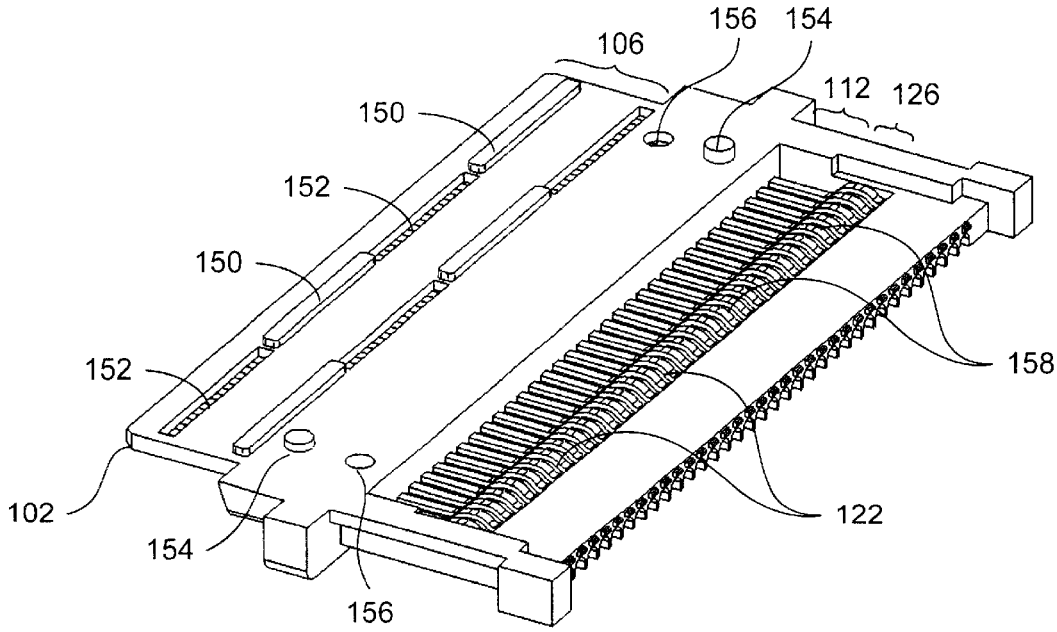
FIG. 4 illustrates a perspective view of the inside surface of the connector component as shown in FIG. 3.

FIG. 3 and FIG. 4 illustrate perspective views of an isolated connector component 102. FIG. 3 is a view of the outside surface (or outer face) of the connector component 102, which includes wire connection region 112. FIG. 4 is a view of the inside surface (or inner face) of the connector component 102, which will make contact with the respective inner face of connector component 104 when connector components 102 and 104 are attached to each other. As seen in FIGS. 3 and 4, when the connector component 102 is separated from component 104, wire contact regions 112 of contact leads 122 are exposed and physically accessible on both the inner and outer faces of connector 102.

Contact leads 122 within FIGS. 3 and 4 can be described using an alternative set of terminology. For instance, contact leads 122 can be described to have at least a first connection portion within wipe area 106 that corresponds to section A of FIG. 2 and a second connection portion that corresponds to wire contact region 112 of FIGS. 3–4 and section B of FIG. 2. The first connection portion is suitable for making contact with an external connector device and the second connection portion is suitable for making contact with electrical wires. As can be seen in FIGS. 3–4, the second connection portion is exposed on both the inner and outer faces of connector component 102. Again, connector components 102 and 104 are designed so that physical access to contact leads 122 on the inner and outer faces of each connector is provided.

As can be seen in FIG. 4, the inside surface of the wipe region 106 has locking bars 150 and locking channels 152. Each of the locking bars 150 and locking channels 152 will fit into locking channels and locking bars, respectively, on a mating connector component. These locking bars and channels help the connector components maintain a relative orientation with respect to each other when attached to each other. Near the locking bars 150 are also formed locking knobs 154 and locking holes 156, which act similarly to lock mating connector components together. As appreciated by those of skill in the art, the locking bars, channels, knobs and holes can have other various shapes, sizes, and positions on the inside surface of the connector components. These various locking features can be generically referred to as locking pegs and recesses. In some embodiments, the locking pegs and recesses can be shaped so that each peg snaps into and is therefore securely held by a respective recess. Such "snap-fitting" pegs and recesses can be used to secure the connection between a pair of connector components.

As shown in FIG. 4, the contact leads 122 are spaced apart from each other such that air spaces 158, spanning from the wire connection area 112 to the device card connection area 126, exist between each of the leads 122. The air spaces 158 increase the electrical performance of the connector device 100 by maximizing the "dielectric constant of air." Of course, it is understood that the contact leads 122, in the wire contact region 112 and the device card contact region 126, could also be embedded in the dielectric material that forms each of the connector components.

Figure 5:
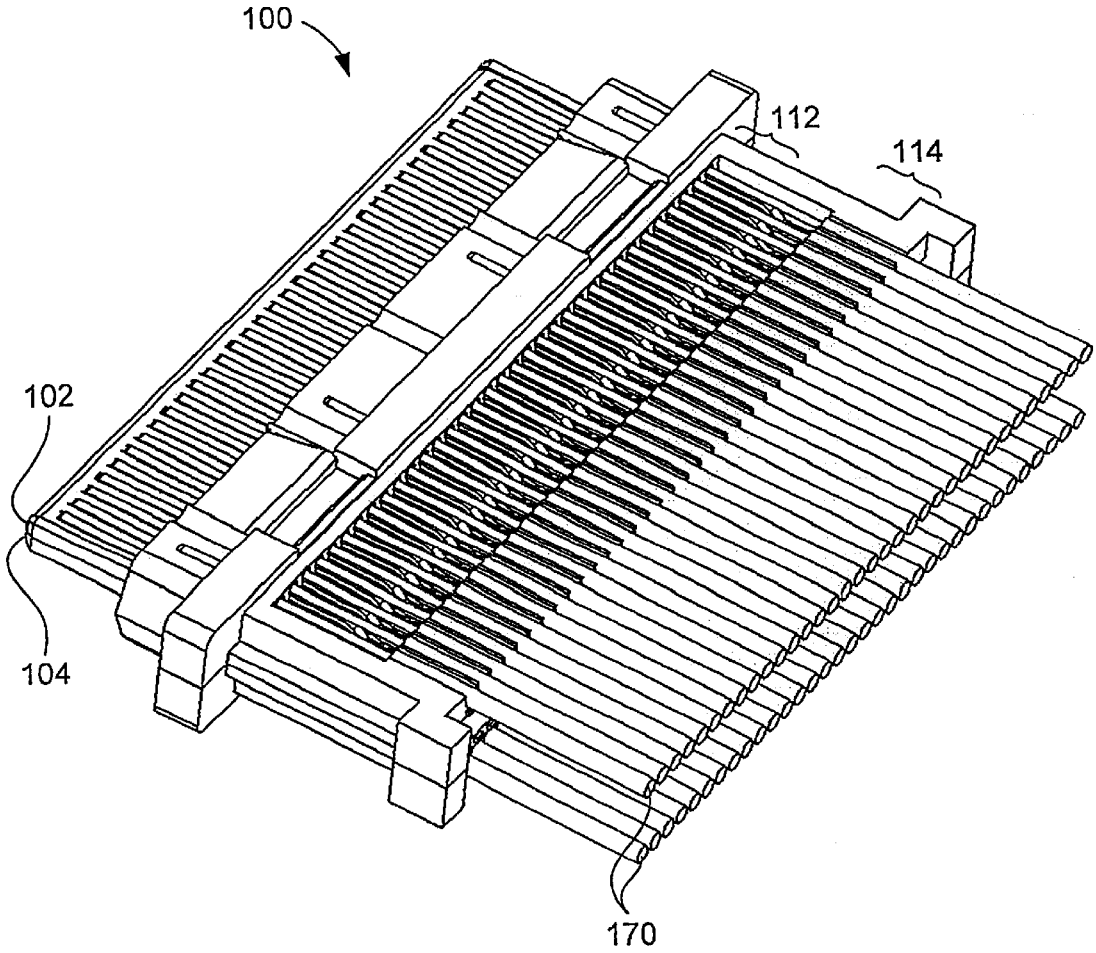
FIG. 5 illustrates a perspective view of a connector device to which discrete wires have been attached.
Figure 6:
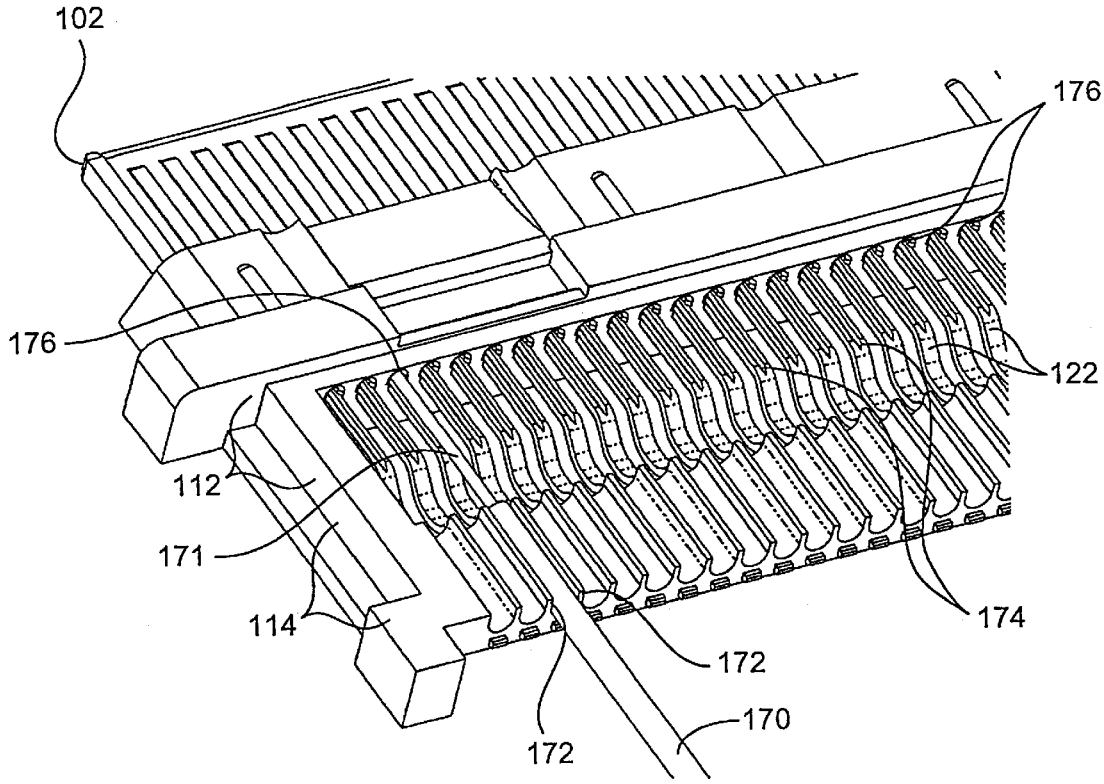
FIG. 6 illustrates a close-up view of a single wire that has been attached to a connector component.

FIGS. 5 and 6 will now be presented to illustrate how discrete wires are connected to the connector device 100. FIG. 5 illustrates a perspective view of a connector device 100 having discrete wires 170 connected to each of the contact leads 122 in the wire connection area 112 of each of connector components 102 and 104. Only the portion of the wires 170 leading out from the wire connection area 112 are shown for simplicity's sake.

FIG. 6 illustrates a close-up, perspective view of connector component 102 and a single, attached wire 170. The insulated portion of the wire 170 is placed between a pair of teeth 172 of the wire retention comb 114. Each pair of teeth 172 are spaced apart so that they securely grip the insulated wire 170. By gripping the insulated portion of the wire 170, the exposed end 171 of the wire 170 can remain in contact with the contact lead 122 regardless of typical external forces exerted on the wires 170 during installation processes. As can be seen, the exposed, conductive end 171 of wire 170 is placed on top of a contact lead 122 to form an electrical connection. In some embodiments of the present invention, the contact leads 122 can be formed to have a recessed trough 174 that runs the length of the contact lead 122 in the wire connection area 112. The recessed troughs 174 are sized such that the exposed portion of the wire 170 can rest within the troughs 174 and therefore be more securely fixed to the contact leads 122. The exposed end 171 of wire 170 is inserted into a registration hole 176 formed in the registration block 110. As can be seen, the registration holes 176 are aligned with each of the contact leads 122. As mentioned earlier, registration holes 176 are recessed areas that secure the ends of the wires so to keep them aligned for proper contact with the contact leads 122. In high data rate transmission applications it is important to terminate each of the discrete wires 170 so that they connect to the contact leads 122 through the same amount of contact area or length. Having the same length is important since the uniformity of contact surface area affects signal propagation. Aligning multiple discrete wires along the registration block 110 and within the registration holes 176 allows the wires to have uniform contact points with the contact leads 122. As mentioned above, the wire 170 can be fixed to the wire connection region 112 of the contact leads 122 either though soldering or welding.

Figure 7:
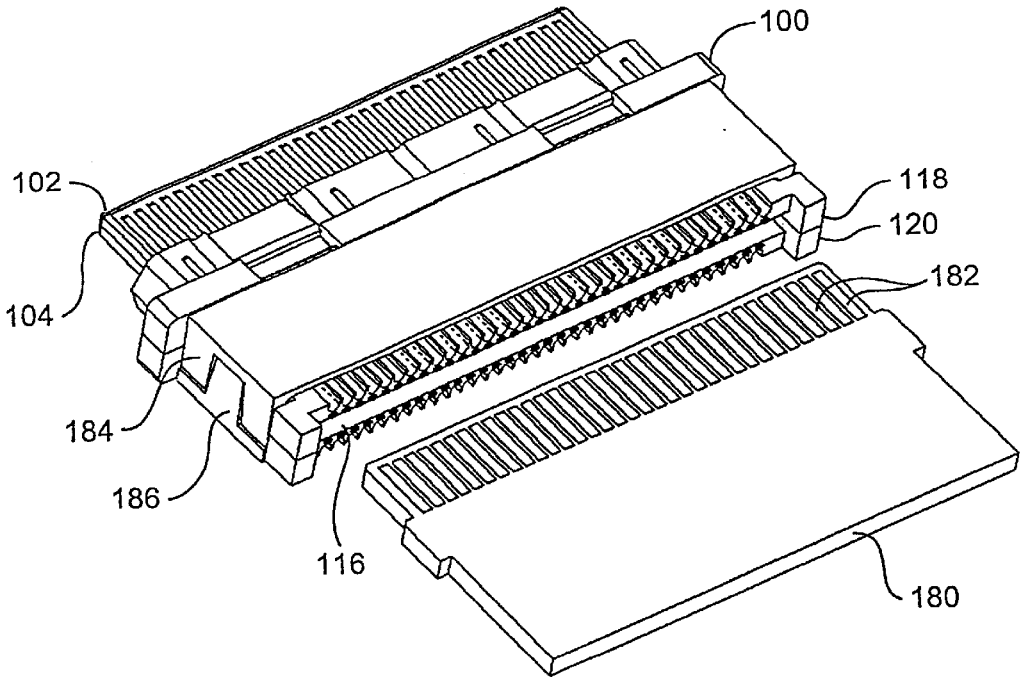
FIG. 7 illustrates a printed circuit board card before being inserted into a connector device according to one embodiment of the present invention.
Figure 8:
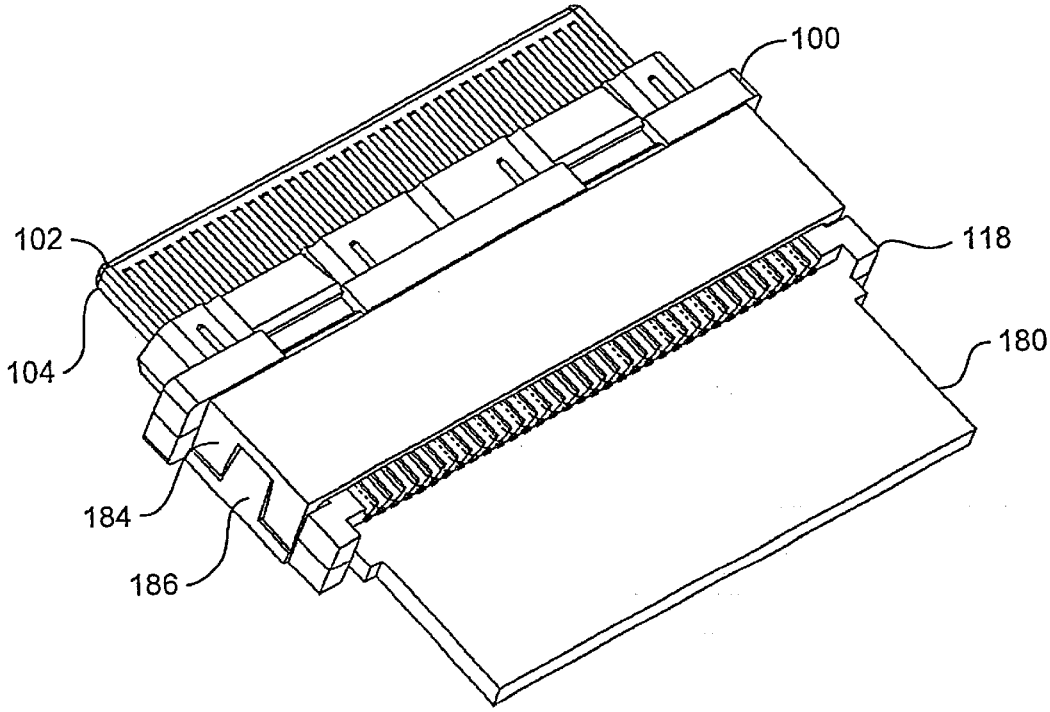
FIG. 8 illustrates the connector device of FIG. 7 within which has been inserted the printed circuit board card.

FIGS. 7 and 8 respectively illustrate connector 100 prior to and after receiving a PCB card 180 according to one embodiment of the present invention. As can be seen in FIG. 7, PCB card 180 is inserted with the end having electrical connection points 182 into the device card slot 116. Once the PCB card 180 is inserted, as seen in FIG. 8, electrical connection points 182 make contact with the electrical contact leads 122 in the device card connection region 126. In some embodiments, the registration surfaces 118 and 120 have an additionally formed hook that is designed to clip onto a notch formed in the PCB card 180 in order to secure the connection between the connector device 100 and the PCB card 180. Not shown, for clarity sake, are the electrical wires that are connected to the PCB card 180. For easier manufacturing, the wires can be connected to the PCB card 180 before the PCB card 180 is inserted into the connector device 100.

Figure 10:
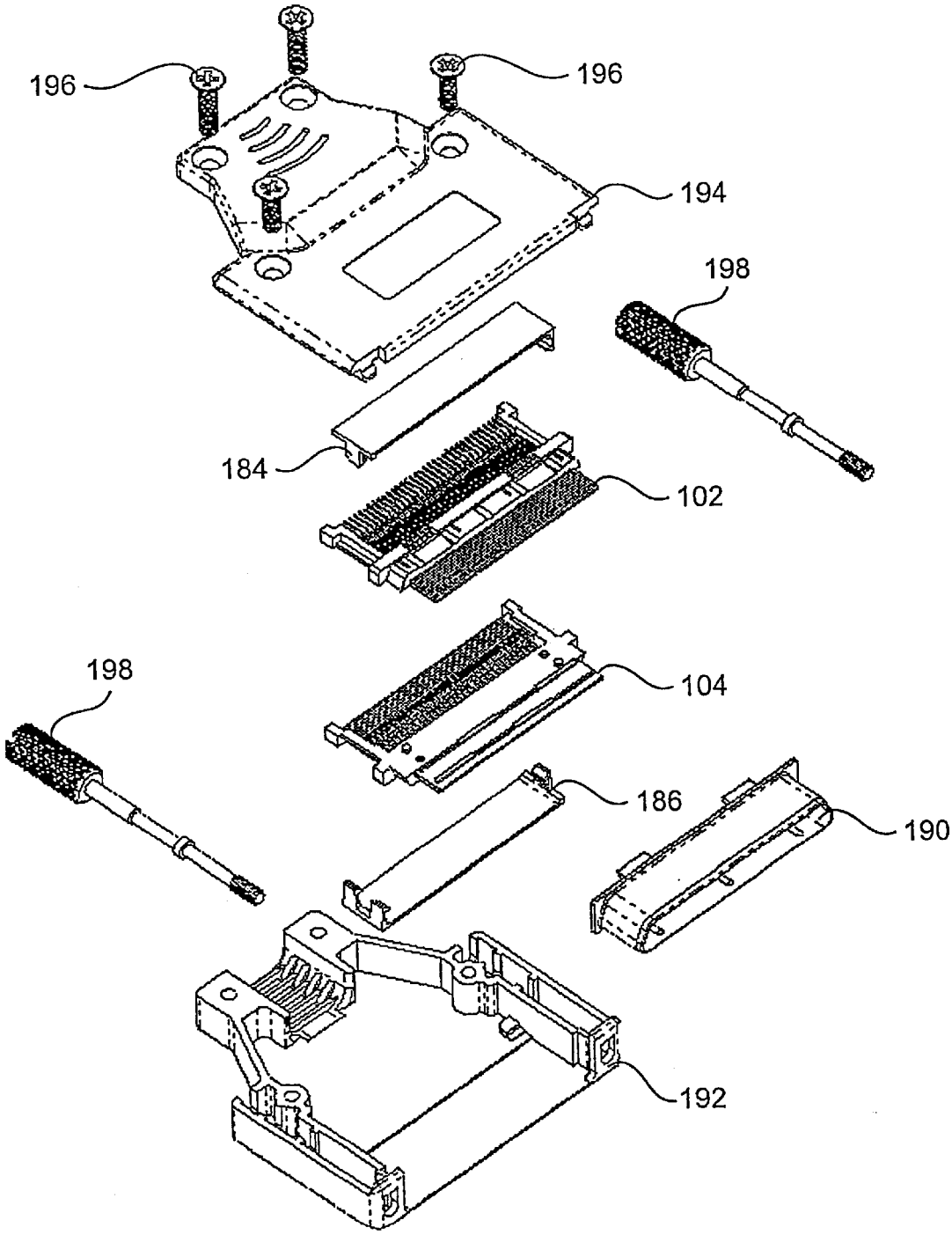
FIG. 10 illustrates an exploded perspective view of a connector device to be installed within an external housing.

Also illustrated in FIGS. 7 and 8 are two locking clamps 184 and 186, which are attached to the connection device 100 in such a way as to wrap around the connection device 100 and hold the individual connector components together. The two locking clamps 184 and 186 wrap around the wire contact regions 112 and the wire retention combs 114 of both connector components 102 and 104. The locking clamps 184 and 186 can have various shapes and sizes such that they can cover more or less area of the connector device 100. As can be seen in FIG. 10, each of clamps 184 and 186 is formed of a flat panel that has clips on either end. The locking clamps 184 and 186 are designed so that their respective panels cover one of the connector components while their respective clips attach to the other connector component. In this manner the locking clamps tend to secure the attachment between the connector components 102 and 104. In some embodiments, the flat panel surfaces of the locking clamps 184 and 186 also press down on the insulated portions of the discrete wires 170 and thereby provide additional strain relief. It is possible to use only one locking clamp, as opposed to using two at the same time.

Clamps 184 and 186 have are the same shape and size, thereby making the manufacture of these pieces easier. However, in alternative embodiments, clamps 184 and 186 can have different shapes and sizes. In alternative embodiments, no locking clamps are required. For instance, in these embodiments, the connector components 102 and 104 may clip to each other or they may be held together with an adhesive material such as epoxy.

Figure 9:
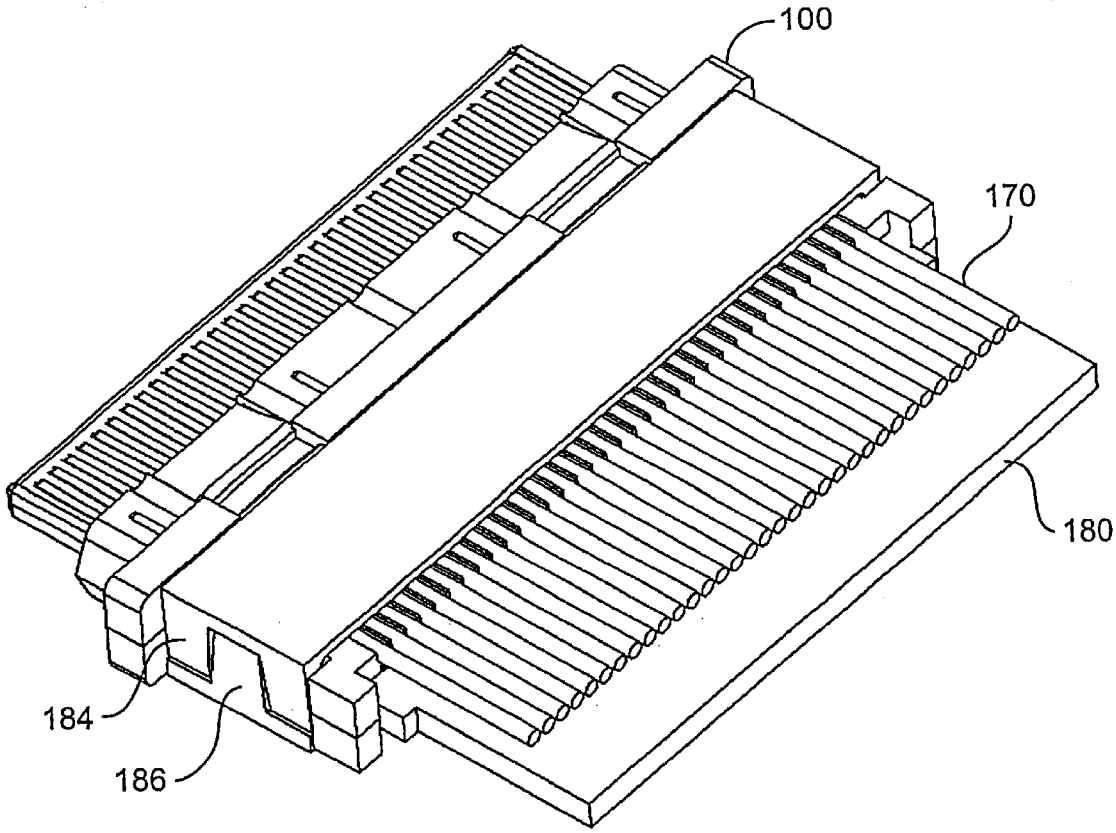
FIG. 9 illustrates a connector device of the present invention to which has been terminated both discrete wires and a printed circuit board card.

FIG. 9 illustrates a perspective view of a connector device 100 utilized in a hybrid manner in which both discrete wires 170 and a PCB card 180 have been connected to the device 100. The hybrid method of using the connector device 100 allows for logic and design specific signals to be carried within the same medium. Potential uses could include active termination assemblies or "smart logic" cable assembly applications.

FIG. 10 illustrates an exploded perspective view of the various components that can be used to utilize a connector device of the present invention in order to form a connection between electrical systems. Starting from the middle of FIG. 10, connector components 102 and 104 will be combined as describe above to form connector device 100. Locking clamps 184 and 186 then lock the connector components 102 and 104 together. Shroud 190 is placed onto the shroud support ledge of the connector device so to protect the exposed contact leads 122 within the wipe area 106. Finally, external housing components 192 and 194 are designed to receive and protect the assembled connector device. Screws 196 are used to lock the connector device within the protective external housing components 192 and 194, and post screws 198 are used to lock the connection device to an electrical system, such as a server or a personal computer. Of course, it is possible to connect various electrical systems utilizing the connector device 100 without the use of the external housing components 192 and 194, however, a more protected and more secure connection can be formed when using such an external housing.

Figure 11:
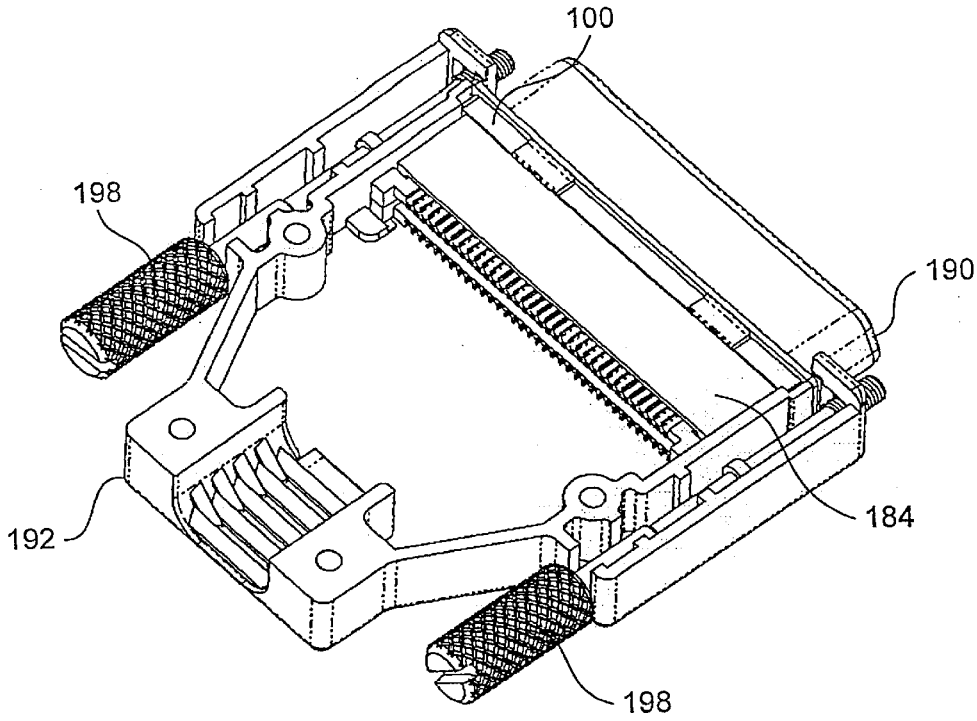
FIG. 11 illustrates an assembled connector device placed within an external housing.
Figure 12:
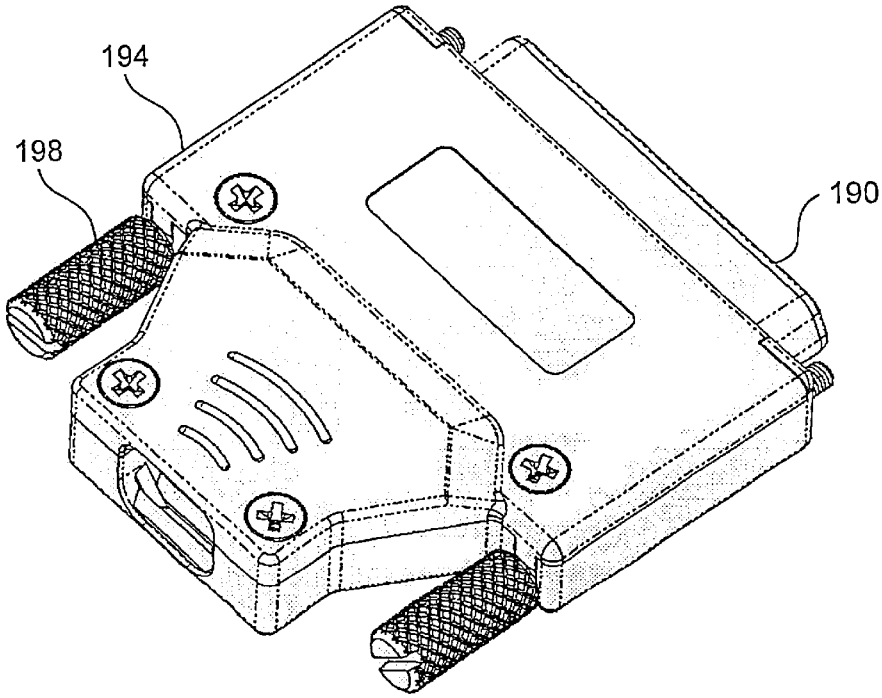
FIG. 12 illustrates a fully assembled external housing that contains a connector device of the present invention.

FIG. 11 illustrates a connector device 100, wrapped in locking clamps and covered by a shroud 190, after it is placed into the bottom external housing component 192. FIG. 12 illustrates the fully assembled connector device that is within the external housing components 192 and 194.

While this invention has been described in terms of several preferred embodiments, there are alteration, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

We claim:

1. A substantially symmetrical electrical connector comprising:

a pair of substantially identical connector components that are attached to each other, each connector component having an inner face and an outer face wherein the inner faces of each respective connector component are attached to each other; and a plurality of contact leads positioned within each of the connector components, each of the plurality of contact leads having a first connection portion suitable for making contact with an external connector device and a second connection portion suitable for making contact with electrical wires, the second connection portion being exposed on both the inner and outer faces of a respective connector component, whereby physical access to the contact leads on the inner and outer faces of each connector component is provided.

2. An electrical connector as recited in claim 1 wherein physical access to the second connection portion on both the inner and outer faces facilitates a process for attaching electrical wire to the second connection portions.

3. An electrical connector as recited in claim 1 wherein each of the connector components includes an opening that has a front edge and a rear edge, each of the contact leads being positioned within the opening and being connected to the front and rear edges of a respective opening.

4. An electrical connector as recited in claim 3 wherein the opening in each connector component is suitably sized so that welding devices can access the contact leads in both the inner and outer faces of a respective connector component so that the wires can be welded to the contact leads.

5. An electrical connector as recited in claim 1 wherein each of the plurality of contact leads further comprises a third connection portion suitable for making contact with traces on an electrical device.

6. An electrical connector as recited in claim 5 wherein the second connection portions and the third connection portions are located on opposing surfaces of the contact leads and wherein the plurality of contact leads within each of the electrical connector components form a slot into which a electrical device can be inserted.

7. An electrical connector as recited in claim 6 wherein the second connection portion of the contact leads have a longitudinal axis and the contact leads have a curved configuration such that the third connection portion of the contact leads are offset from the longitudinal axis of the second connection portions such that the distance between respective third connection portions in each of the electrical connector components is smaller than the distance between respective second connection portions in each of the electrical connector components, each of the second and third connection portions of the contact leads forming a leaf spring configuration.

8. An electrical connector as recited in claim 1 wherein the second connection portion of each contact lead is in the outer face of a respective connector component.

9. An electrical connector as recited in claim 8 wherein the second connection portions are elongated and have a substantially flat contact surface.

10. An electrical connector as recited in claim 9 wherein at least some of the second connection portions further comprise:

an elongated and recessed trough formed in the contact surface wherein the recessed trough is suitable receiving and aligning a lengthwise portion of a respective electrical wire.

11. An electrical connector as recited in claim 1 wherein each of the connector components further comprise:

a registration block having a plurality of registration recesses being positioned proximate to the second connection portion of an associated contact lead and configured to receive and position an end portion of an associated wire to be connected to the second connection portion of the associated contact lead.

12. An electrical connector as recited in claim 11 wherein each of the registration recesses has a center and a distance between the centers of each pair of adjacent registration recesses on each of the electrical connector components is approximately 0.8 mm.

13. An electrical connector as recited in claim 11 wherein the registration recesses have substantially the same depth.

14. An electrical connector as recited in claim 11 wherein the registration recesses of each registration block have registration surfaces that are aligned along respective axes such that when wires are attached to the second connection portions of the contact leads with their respective wire ends engaging the registration surfaces, the ends of the wires are aligned along the respective axis.

15. An electrical connector as recited in claim 14 wherein the registration recesses position the end portion of the associated wires such that the longitudinal axes of the segment of the wires to be connected to the second connection portions of the contact leads are aligned with the longitudinal axes of the associated contact leads.

16. An electrical connector as recited in claim 11 wherein each of the connector components further comprise:

a wire retention comb supported by the plurality of contact leads and spaced apart from the registration block such that the second connection portion is exposed between the registration block and the wire retention comb, the wire retention comb including a row of teeth wherein at least one adjacent pair of teeth is configured to secure an associated wire that is to be connected to the second connection portion of a selected one of the contact leads.

17. An electrical connector as recited in claim 16 wherein one of the pair of electrical connector components is a first connector component and the other is a second connector component, the electrical connector further comprising:

a first latch having a panel and at least two clasps wherein one clasp extends from a first end of the panel and another clasp extends from a second end of the panel, the panel covering at least a portion of the wire retention comb of the first connector component and the clasps secured to the second connector component such that the clasps lock the first and second connector components together, the panel being suitable for making contact with the wires connected to the second connection portion of the contact leads such that the wires are locked into the teeth of the retention comb of the first connector component.

18. An electrical connector as recited in claim 17 further comprising:

a second latch having a panel and at least two clasps wherein one clasp extends from a first end of the panel and another clasp extends from a second end of the panel, the panel covering at least a portion of the wire retention comb of the second connector component and the clasps secured to the first connector component such that the clasps lock the first and second connector components together, the panel being suitable for making contact with the wires connected to the second connection portion of the contact leads such that the wires are locked into the teeth of the retention comb of the second connector component.

19. An electrical connector comprising:

a pair of substantially identical connector components that are attached to each other, each connector component having an inner face and an outer face, each of the connector components includes an opening that has a front edge and a rear edge;

a plurality of contact leads within each of the connector components, the contact leads being positioned within a respective opening and being connected to the front and rear edges of a respective opening, the contact leads having a first connection portion suitable for making contact with an external connector device, a second connection portion suitable for making contact with electrical wires, and a third connection portion suitable for making contact with traces on an electrical device, the second connection portion of the contact leads being exposed on both the inner and outer faces of a respective connector component, whereby physical access to the contact leads on the inner and outer faces of each connector component is provided; and wherein the second connection portions and the third connection portions are located on opposing surfaces of the contact leads and wherein the plurality of contact leads within each of the electrical connector components form a slot into which a electrical device can be inserted.

20. An electrical connector as recited in claim 19 wherein the second connection portion of the contact leads have a longitudinal axis and the contact leads have a curved configuration such that the third connection portion of the contact leads are offset from the longitudinal axis of the second connection portions such that the distance between respective third connection portions in each of the electrical connector components is smaller than the distance between respective second connection portions in each of the electrical connector components, each of the second and third connection portions of the contact leads forming a leaf spring configuration.

21. An electrical connector as recited in claim 19 wherein each of the connector components further comprise:

a registration block having a plurality of registration recesses being positioned proximate to the second connection portion of an associated contact lead and configured to receive and position an end portion of an associated wire to be connected to the second connection portion of the associated contact lead.

22. An electrical connector as recited in claim 21 wherein the distance between the centers of each pair of adjacent registration recesses on each of the electrical connector components is approximately 0.8 mm.

23. An electrical connector as recited in claim 21 wherein the registration recesses of each registration block have registration surfaces that are aligned along respective axes such that when wires are attached to the second connection portions of the contact leads with their respective wire ends engaging the registration surfaces, the ends of the wires are aligned along a respective axis.

24. An electrical connector as recited in claim 21 wherein the registration recesses position the end portion of the associated wires such that the longitudinal axes of the segment of the wires to be connected to the second connection portions of the contact leads are aligned with the longitudinal axes of the associated contact leads.

25. An electrical connector as recited in claim 21 wherein each of the connector components further comprise:

a wire retention comb supported by the plurality of contact leads and spaced apart from the registration block such that the second connection portion is exposed between the registration block and the wire retention comb, the wire retention comb including a row of teeth wherein at least one adjacent pair of teeth is configured to secure an associated wire that is to be connected to the second connection portion of a selected one of the contact leads.

26. An electrical connector as recited in claim 19 wherein the second connection portions are elongated and have a substantially flat contact surface.

27. An electrical connector as recited in claim 26 wherein at least some of the second connection portions further comprise:

an elongated and recessed trough formed in the contact surface wherein the recessed trough is suitable receiving and aligning a lengthwise portion of a respective electrical wire.

28. An electrical connector as recited in claim 21 wherein the registration recesses have substantially the same depth.

29. An electrical connector as recited in claim 28 wherein one of the pair of electrical connector components is a first connector component and the other is a second connector component, the electrical connector further comprising:

a first latch having a panel and at least two clasps wherein one clasp extends from a first end of the panel and another clasp extends from a second end of the panel, the panel covering at least a portion of the wire retention comb of the first connector component and the clasps secured to the second connector component such that the clasps lock the first and second connector components together, the panel being suitable for making contact with the wires connected to the second connection portion of the contact leads such that the wires are locked into the teeth of the retention comb of the first connector component.

30. An electrical connector as recited in claim 29 further comprising:

a second latch having a panel and at least two clasps wherein one clasp extends from a first end of the panel and another clasp extends from a second end of the panel, the panel covering at least a portion of the wire retention comb of the second connector component and the clasps secured to the first connector component such that the clasps lock the first and second connector components together, the panel being suitable for making contact with the wires connected to the second connection portion of the contact leads such that the wires are locked into the teeth of the retention comb of the second connector component.

31. An electrical connector comprising:

a pair of electrical connector components that each have an inner face and an outer face wherein the inner faces of the connector components are attached to each other, each electrical connector component including a plurality of contact leads, each of which have a first connection portion and a second connection portion, the first connection portion configured to connect to an external electrical system, at least a portion of each of the contact leads being exposed on both the inner and outer faces of a respective connector component, whereby physical access to the contact leads on the inner and outer faces of each connector component is provided; and a registration block having a plurality of registration recesses, each of the registration recesses being positioned proximate to the second connection portion of an associated contact lead and configured to receive and position an end portion of an associated wire to be connected to the second connection portion of the associated contact lead.

32. An electrical connector as recited in claim 31 wherein the distance between the centers of each pair of adjacent registration recesses on each of the electrical connector components is approximately 0.8 mm.

33. An electrical connector as recited in claim 31 wherein each of the electrical connector components further comprise:

a wire retention comb supported by the contact leads and spaced apart from the registration block such that the second connection portion is exposed between the registration block and the wire retention comb, the wire retention comb including a row of teeth wherein at least one adjacent pair of teeth is configured to secure an associated wire that is to be connected to the second connection portion of a selected one of the contact leads.

34. An electrical connector as recited in claim 31 wherein each of the electrical connector components are substantially identical.

35. An electrical connector as recited in claim 31 wherein each of the connector components includes an opening that has a front edge and a rear edge, each of the contact leads being positioned within the opening and being connected to the front and rear edges of a respective opening.

36. An electrical connector as recited in claim 31 wherein the second connection portions are elongated and have a substantially flat contact surface.

37. An electrical connector as recited in claim 36 wherein at least some of the second connection portions further comprise:

an elongated and recessed trough formed in the contact surface wherein the recessed trough is suitable receiving and aligning a lengthwise portion of a respective electrical wire.

* * * * *